US008443646B2

(12) United States Patent
Pelech

(10) Patent No.: US 8,443,646 B2
(45) Date of Patent: May 21, 2013

(54) COMPENSATION DEVICE FOR A PRESS BRAKE

(76) Inventor: Bruno J. Pelech, Mokena, IL (US)

( * ) Notice: Subject to any disclaimer, the term of this patent is extended or adjusted under 35 U.S.C. 154(b) by 230 days.

(21) Appl. No.: 13/089,676

(22) Filed: Apr. 19, 2011

(65) Prior Publication Data

US 2012/0266645 A1 Oct. 25, 2012

(51) Int. Cl.
*B21D 5/02* (2006.01)
*B21D 37/04* (2006.01)

(52) U.S. Cl.
USPC ..... 72/389.4; 72/389.5; 72/448

(58) Field of Classification Search ..... 72/389.4, 72/389.5, 446, 448
See application file for complete search history.

(56) References Cited

U.S. PATENT DOCUMENTS

| | | | | |
|---|---|---|---|---|
| 2,199,864 | A * | 5/1940 | Wehr | 72/448 |
| 4,449,389 | A * | 5/1984 | Cros | 72/389.5 |
| 4,586,361 | A * | 5/1986 | Reinhorn et al. | 72/389.5 |
| 4,736,612 | A * | 4/1988 | Russell | 72/389.5 |
| 4,898,015 | A * | 2/1990 | Houston | 72/389.5 |
| 5,009,098 | A | 4/1991 | van Merksteijn | |
| 5,022,256 | A | 6/1991 | van der Meulen | |
| 5,103,665 | A | 4/1992 | van Merksteijn | |
| 5,245,854 | A | 9/1993 | Bruggink et al. | |
| 6,164,114 | A | 12/2000 | Pelech, Jr. | |
| 6,494,075 | B1 | 12/2002 | Pelech, Jr. | |
| 6,499,330 | B1 | 12/2002 | Pelech, Jr. | |
| 6,578,403 | B2 * | 6/2003 | Gascoin | 72/389.4 |
| 6,732,564 | B2 | 5/2004 | Runk et al. | |
| 6,928,852 | B2 | 8/2005 | Enderink | |
| 7,168,286 | B1 | 1/2007 | Pelech | |
| 7,325,428 | B2 | 2/2008 | Bruggink | |
| 7,632,224 | B2 | 12/2009 | Rouweler et al. | |
| 7,647,805 | B2 * | 1/2010 | Yamamoto | 72/389.4 |
| 7,791,726 | B2 | 9/2010 | Bruggink | |
| 7,810,369 | B2 | 10/2010 | Rouweler et al. | |
| 2006/0107727 | A1 | 5/2006 | Pelech | |
| 2008/0040864 | A1 | 2/2008 | Rouweler et al. | |
| 2008/0252024 | A1 | 10/2008 | Rouweler | |
| 2009/0217731 | A1 | 9/2009 | Rouweler et al. | |
| 2011/0247389 | A1 | 10/2011 | Rouweler et al. | |

* cited by examiner

*Primary Examiner* — David B Jones
(74) *Attorney, Agent, or Firm* — Marshall, Gerstein & Borun LLP

(57) ABSTRACT

An adjustment compensator device for a press brake die includes an elongate engagement member, an elongate die holder, an elongate primary adjustment wedge and at least two elongate secondary adjustment wedges. The elongate primary adjustment wedge is positioned between and extending along at least a portion of the elongate engagement member and the elongated die holder, and at least a portion of primary adjustment wedge is adjustable in a direction transverse to an elongate length of the engagement member. The at least two elongate secondary adjustment wedges have a length wherein each of the secondary adjustment wedges is less than a length of the primary adjustment wedge. The elongate secondary adjustment wedges are positioned end to end in a direction along a length of the die holder and positioned between the engagement member and the die holder. Each of the elongate secondary adjustment wedges is adjustable in a direction transverse to the elongate length of the engagement member.

36 Claims, 10 Drawing Sheets

COMPENSATION DEVICE FOR A PRESS BRAKE

FIELD OF INVENTION

This invention generally relates to press brakes and, more particularly, to devices that provide vertical adjustment to the position of a die in a press brake to deform a work piece and to provide consistency with the deformation of the work piece along the length of the work piece.

SUMMARY

An example includes an adjustment compensator device for a press brake die which includes an elongate engagement member and an elongate die holder. It also includes an elongate primary adjustment wedge positioned between and extending along at least a portion of the elongate engagement member and the elongated die holder, and at least a portion of primary adjustment wedge is adjustable in a direction transverse to an elongate length of the engagement member. It further includes at least two elongate secondary adjustment wedges wherein a length of each of the secondary adjustment wedges is less than a length of the primary adjustment wedge, wherein the elongate secondary adjustment wedges are positioned end to end in a direction along a length of the die holder and positioned between the engagement member and the die holder. The secondary adjustment wedges are each adjustable in a direction transverse to the elongate length of the engagement member.

Another example includes an adjustment compensator device for a press brake die which includes a bolt segment having a length and defining threads along at least a portion of the length, wherein the length of the bolt segment substantially matches a distance between two opposing walls positioned within one of a die holder and an engagement member such that opposing ends of the bolt segment abut the two opposing walls. It also includes a bolt head segment adapted to couple with the bolt segment, wherein one of the bolt segment and the bolt head segment define a bore opening and the other of bolt segment and bolt head segment includes an extension such that the extension is accessible through another bore opening defined in one of the die holder and engagement member and is receivable within the bore opening defined in the one of the bolt segment and the bolt head segment.

Another example includes a method for assembling an adjustable compensator device for a press brake which includes the steps of engaging a bolt segment which defines threads along at least a portion of a length thereof with a threaded bore defined in a force transmittal member and positioning a portion of the bolt segment to extend outwardly from one side of the force transmittal member and positioning another portion of the bolt segment to extend outwardly from an opposing side of the force transmittal member. The method further includes placing the bolt segment and force transmittal member between two opposing walls within an engagement member such that opposing ends of the bolt segment abut the two opposing walls.

Another example includes a method for assembling an adjustable compensator device for a press brake, which includes the steps of engaging a bolt segment which defines threads along at least a portion of a length thereof with a threaded bore defined in an adjustment wedge and positioning a portion of the bolt segment to extend outwardly from one side of the adjustment wedge and positioning another portion of the bolt segment to extend outwardly from an opposing side of the adjustment wedge. The method further includes placing the bolt segment and the adjustment wedge between two opposing walls within a die holder such that opposing ends of the bolt segment abut the two opposing walls.

Another example includes an adjustment compensator device for a press brake die which includes a bolt segment having a length and defining threads along at least a portion of the length, wherein the length of the bolt segment substantially matches a distance between two opposing walls positioned within one of a die holder and an engagement member such that opposing ends of the bolt segment abut the two opposing walls. The example also includes a bolt head segment adapted to couple with the bolt segment, wherein the bolt head segment defines at least one channel positioned circumferentially about the bolt head segment and wherein an o-ring is positioned within the at least one channel.

DETAILED DESCRIPTION

Figure 1:
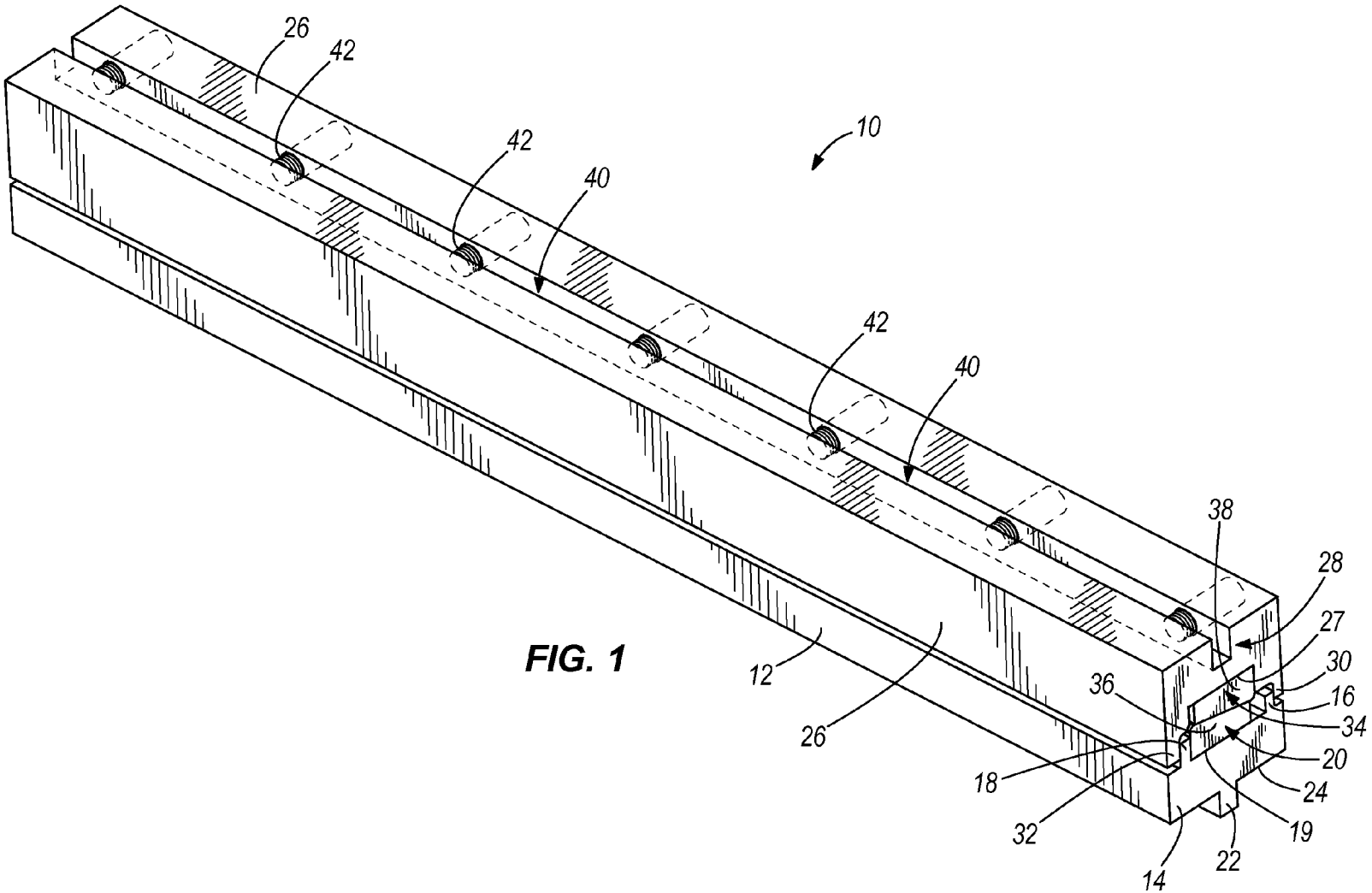
FIG. 1 is a top back perspective view of an exemplary embodiment of an assembled compensation device for a press brake die.
Figure 2:
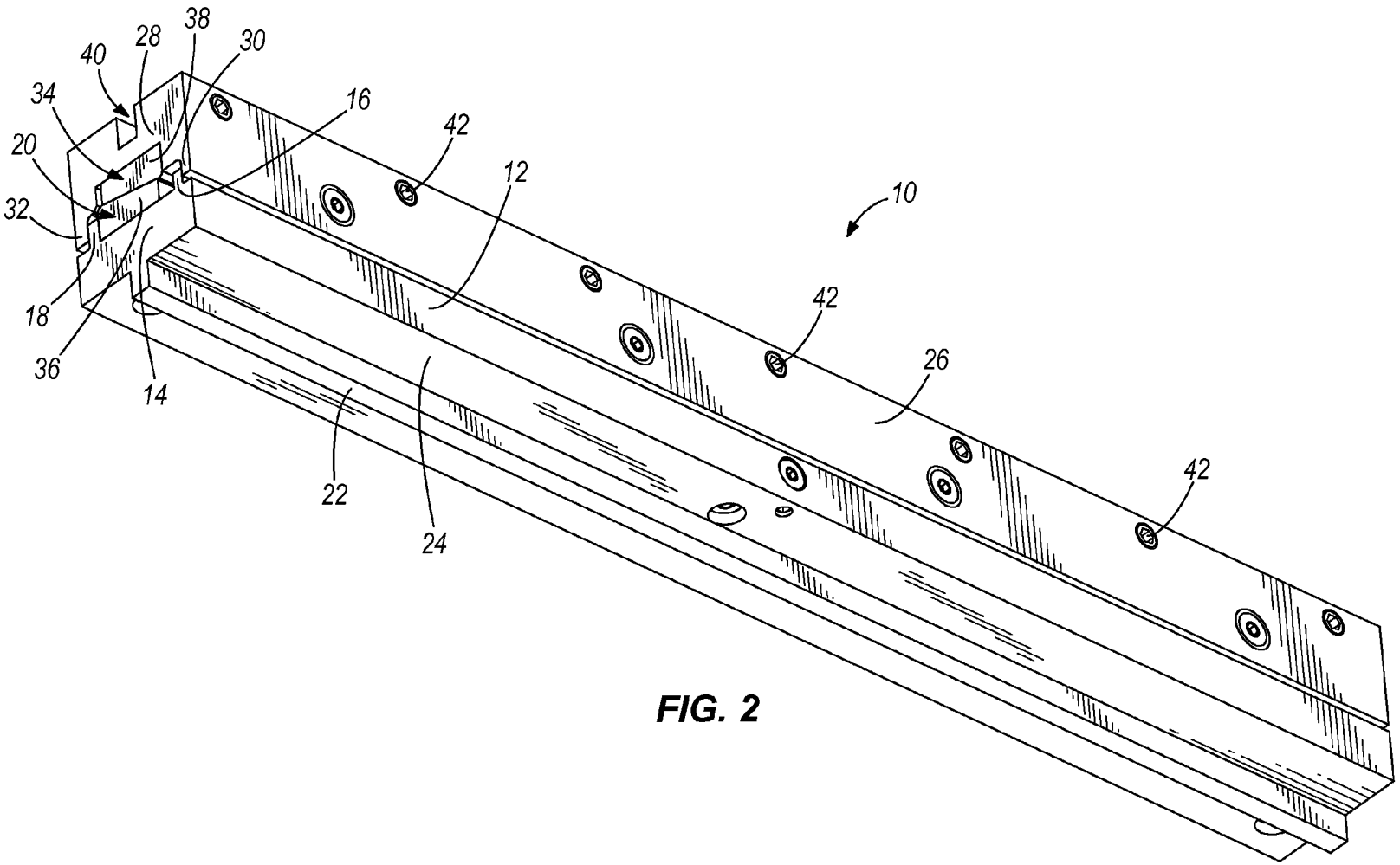
FIG. 2 is a bottom front perspective view of the exemplary embodiment of the assembled compensation device for a press brake die as shown in FIG. 1.

With reference to FIGS. 1 and 2, an exemplary assembled compensation device 10 for a press brake die is shown. Compensation device 10 is fabricated from metal and in this example is fabricated 4150 press brake steel. Compensation device 10 includes press brake bed engagement member 12 which is positioned to engage a press bed (not shown). Engagement member 12 includes base 14 and opposing sidewalls 16, 18. For purposes of this description wall member 16 is positioned proximate to the front of compensation device 10 and wall 18 is positioned proximate to the back of compensation device 10. Additionally, the use of horizontal, vertical and the like is used to describe relative orientations of items to one another and not necessarily an absolute position. Floor 19 spans between sidewalls 16, 18 and with sidewalls 16, 18 forms channel 20 throughout the length of engagement member 12. Opposing sidewalls 16, 18 are positioned generally parallel to one another along the length of engagement member 12 and are extending from floor 19 generally at right angle or vertical relative to floor 19. Floor 19 is generally flat and extends generally horizontal along the length of engagement member 12. Locking member 22 extends from base 14 and in conjunction with substantially planar bottom 24 of base 14, these components cooperatively engage and provide a snug fit with corresponding components of a bed of a press brake (not shown). This cooperative arrangement provides a stable engagement between engagement member 12 and the press brake during operation of the press brake in configuring a work piece with a die that is held by compensation device 10.

Figure 6:
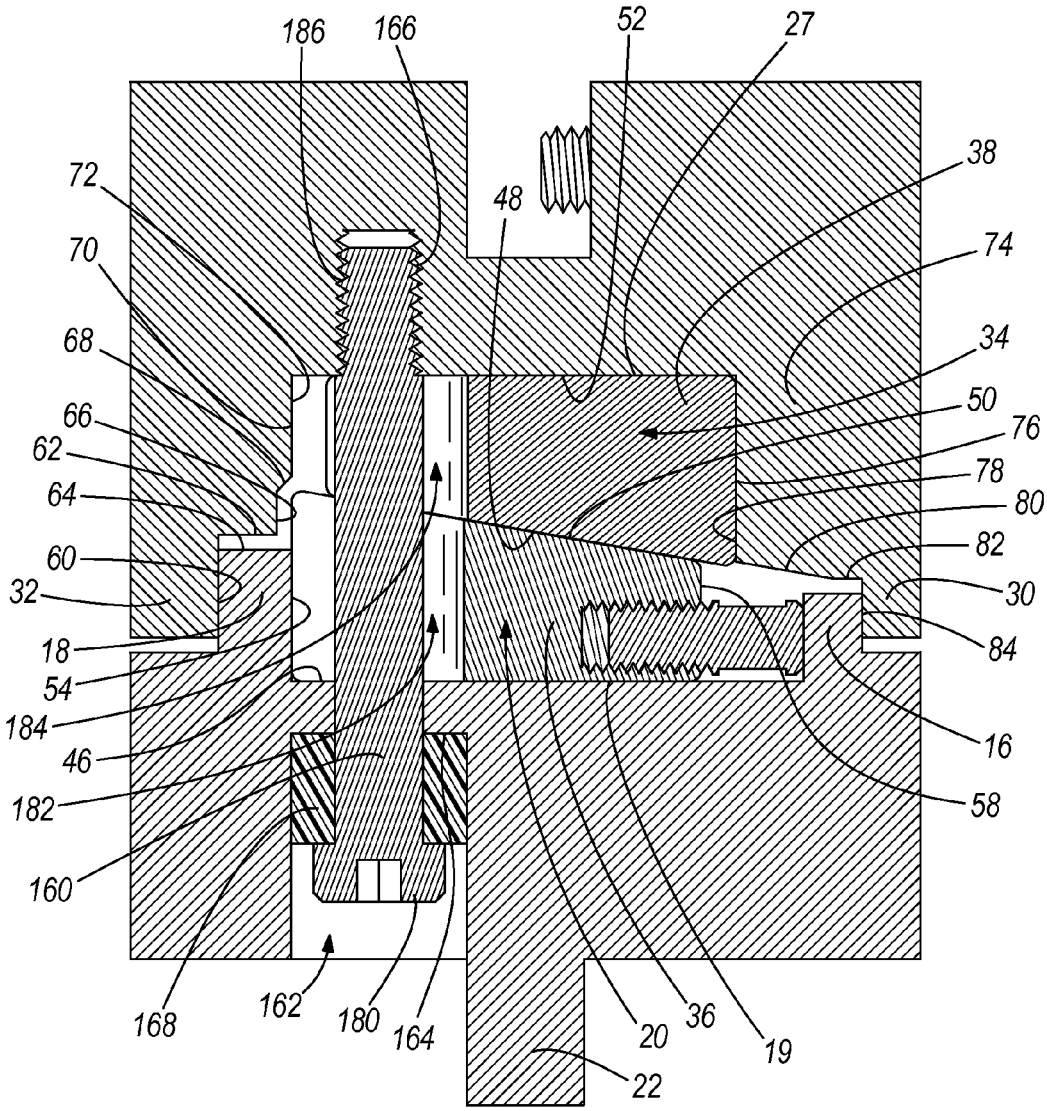
FIG. 6 is a cross section view of the assembled compensation device for a press brake die as seen along line 6-6 of FIG. 5.

Compensation device 10 further includes die holder 26 which includes a top portion 28 and opposing sidewalls 30, 32. Opposing sidewalls 30, 32 extend generally parallel to one another along the length of die holder 26. Opposing sidewalls 30, 32 are spaced apart sufficiently to permit them to respectively slide over the outside of opposing sidewalls 16, 18, of engagement member 12, respectively, as seen in FIGS. 6 sand 7. This configuration permits die holder 26 to move or elevate relative to engagement member 12 which is engaged or held by the press brake. Channel 20 formed by engagement member 12 receives elongated primary adjustment wedge 36 which, in this embodiment, extends the length of compensation device 10 and will be used, as described later, to elevate die holder 26 relative to engagement member 12.

Figure 4:
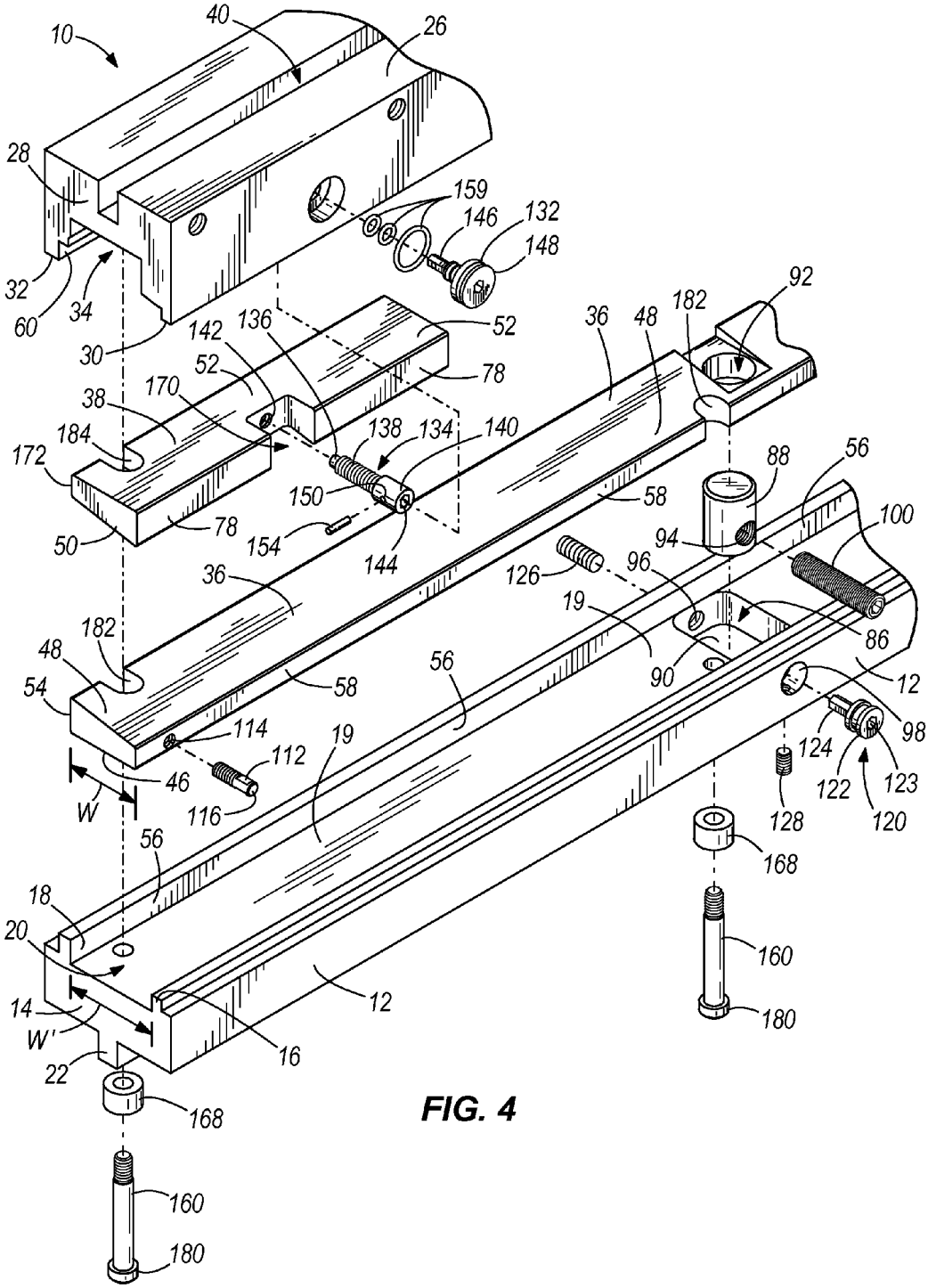
FIG. 4 is an enlarged partial view of the exemplary embodiment of the assembled compensation device for a press brake die as shown in FIG. 3.
Figure 7:
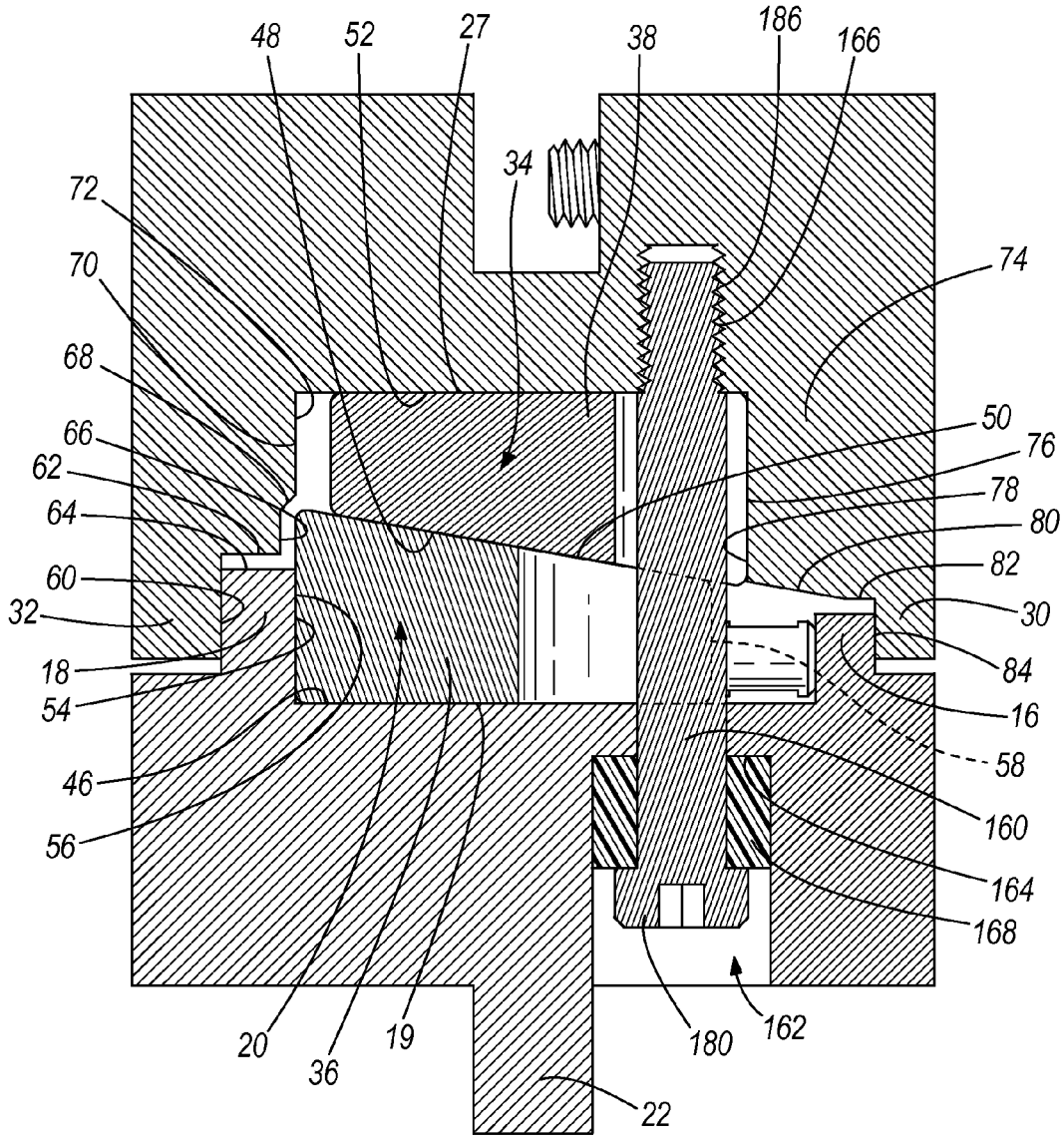
FIG. 7 is a cross section view of the assembled compensation device for a press brake die as seen along line 7-7 of FIG. 5.

As can be seen in FIGS. 4, 6 and 7, die holder 26 defines channel 34 which extends the length of die holder 26. Ceiling 27 of channel 34 is generally flat along the length of die holder 26 and is oriented generally horizontal and parallel to floor 19 of engagement member 12 with die holder 26 engaged to engagement member 12, as seen in FIGS. 6 and 7. Channel 34 will be discussed in further detail below. With die holder 26 engaged to engagement member 12, channels 20 and 34 are in communication with one another and, in this embodiment, they extend the length of compensation device 10. Channel 34, of die holder 26 receives, as will be discussed in further detail below, elongated secondary adjustment wedges 38 which are, in this embodiment, positioned end to end along the length of compensation device 10. Elongated secondary adjustment wedges 38 will provide localized elevation changes to die holder 26 relative to engagement member 12 and, in turn, provide localized elevation adjustments to a die held by die holder 26.

Die holder 26 not only holds or secures a die (not shown) in position in order for a press brake (not shown) to deform or bend a work piece with the die, but it also imparts elevation changes to the die, such as imparting a crown configuration from movement of location of elongated primary adjustment wedge 36 as will be discussed further below. With such crown configuration imparted to a die, a generally more consistent result in bending the work piece along the length of the work piece will occur. In order to have die holder 26 hold a die and impart configuration changes to the die, die holder 26 defines a channel 40 in the top of compensation device 10. Channel 40 along with spaced apart threaded bolts 42 that extend into channel 40 and are positioned along the length of channel 40. With a die positioned within channel 40, bolts 42 can be tightened thereby securing the die to die holder 26. With the die secured to die holder 26, die holder 26 can impart elevation changes to the die relative to engagement member 12. When the die is no longer needed, bolts 42 may be loosened and the die removed.

Figure 3:
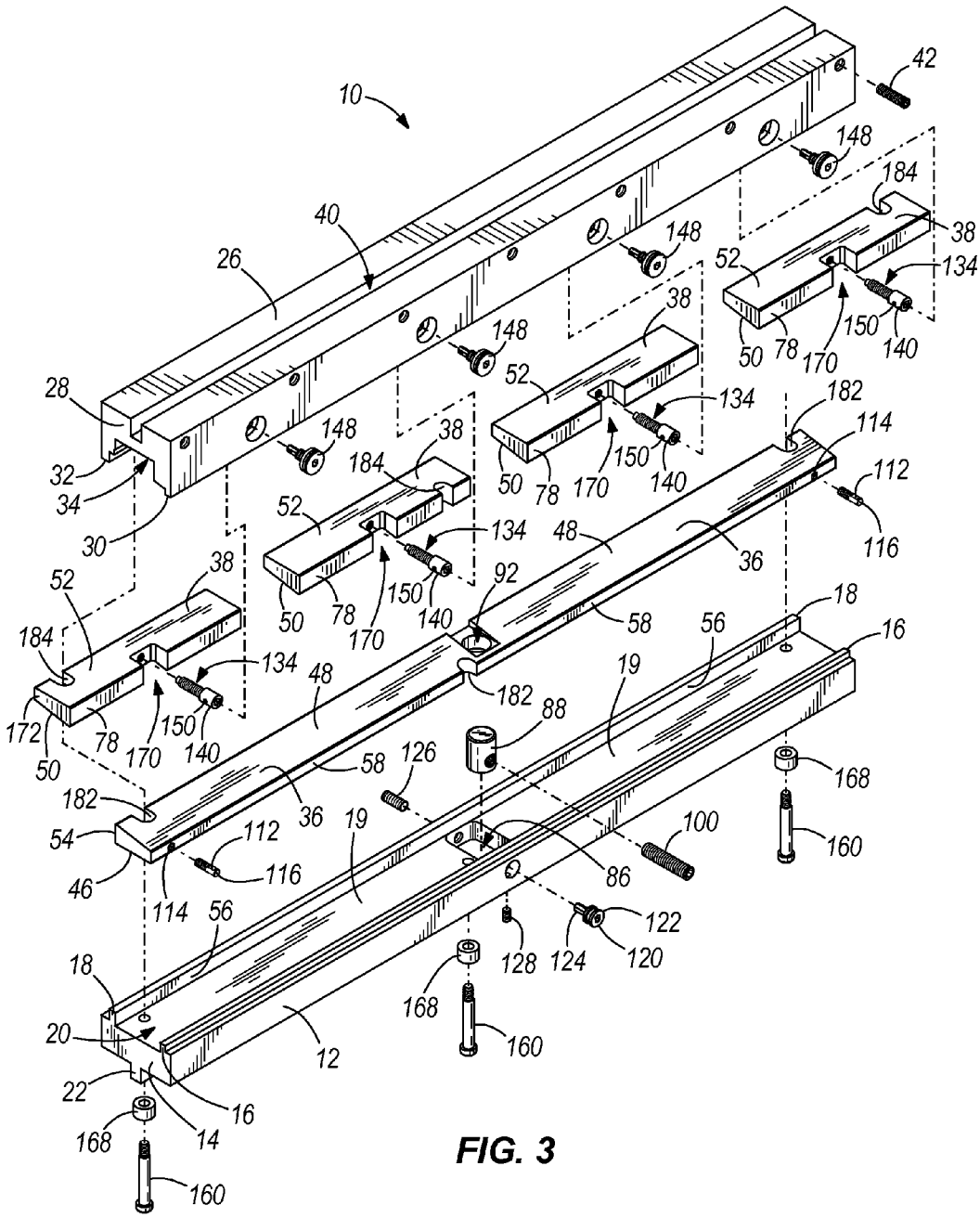
FIG. 3 is top front perspective exploded view of the exemplary embodiment of the assembled compensation device for a press brake die as shown in FIG. 1.

In referring to FIGS. 3 and 4, as well as FIGS. 6 and 7, a more detailed view of the assembly of compensation device 10 can be seen. Engagement member 12, in this embodiment, forms channel 20 with, as mentioned above, opposing walls 16, 18 which extend the length of engagement member 12 and are generally parallel to one another and with floor 19 of engagement member 12 spanning between opposing walls 16, 18. Floor 19 of engagement member 12 is generally flat along the length of channel 20 and is positioned at a right angle to wall members 16, 18. Floor 19 is also, in this embodiment, in a generally horizontal position when secured to the press brake. Elongated primary adjustment wedge 36 includes a flat bottom 46 permitting bottom 46 to abut floor 19 along the length of channel 20 of engagement member 12, Elongated primary adjustment wedge 36, in this embodiment, is generally coextensive in length to channel 20 of engagement member 12. With bottom 46 of elongated primary adjustment wedge 36 resting flatly on floor 19 of channel 20, opposing face or top 48 of elongated wedge 36 is oriented in an inclined position relative to flat bottom 46. A width dimension W of wedge 36 taken in a direction transverse to the length of engagement member 12, as seen in FIG. 4, is smaller than a width dimension W' of channel 20 taken in a direction transverse to the length of the engagement member 12. With the width dimension of elongated primary adjustment wedge 36 being smaller than the width dimension W' of channel 20 of engagement member 12, this difference permits elongated primary adjustment wedge 36 to be moved within channel 20 in a direction transverse to the elongated direction to which engagement member 12 extends.

It should be appreciated that compensation device 10 can vary in length as needed. In some instances the die may be shorter in other instances the die may need to be longer depending on the work piece to be configured. Correspondingly, the length of primary adjustment wedge 36 will also vary in length. As seen in FIG. 3, primary adjustment wedge 36 substantially spans the length of compensation device 10. Secondary adjustment wedges 38 may be also made of various lengths. Compensation devices can commonly be 6 to 16 feet in length, in contrast, the length of secondary wedges 38 may vary from 6 inches to two feet. A typical length for wedge 38 would be approximately 8 inches. Length selection of secondary adjustment wedges 38 can vary depending on the need for localization of the adjustments needed in adjusting the elevation of die holder 26.

With respect to secondary adjustment wedges 38, they are dimensioned in length so as to permit secondary adjacent wedge 38 members to be able to move in a transverse direction relative to the elongate length of engagement member 12 and relative to one another. Secondary adjustment wedge members 38 include an inclined bottom surface 50 which is parallel to inclined top surface 48 of elongated wedge 36, with compensation device 10 assembled, as shown in FIGS. 6 and 7. Bottom surface 50 of secondary adjustment wedge 38 rests upon top surface 48 of elongate wedge 36, permitting ease in secondary wedge 38 and elongate wedge 36 to slide along the corresponding parallel inclined top and bottom surfaces 48 and 50, relative to one another. The angle of inclination of each of these top and bottom surfaces 48 and 50, in this embodiment, are about ten degrees, relative to horizontal. However, other complimentary angles of inclination can be selected as needed.

In further referring to FIGS. 6 and 7, wherein compensation device 10 is assembled, secondary wedges 38 and elongate primary adjustment wedge 36 are confined between engagement member 12 and die holder 26 with the flat horizontal top surface 52 of wedge 38 abutting flat horizontal ceiling 27 and bottom flat horizontal surface 46 of primary wedge 36 abutting flat horizontal floor 19 of engagement member 12. It should be appreciated that this confinement of flat horizontal abutting surfaces on the top of wedge 38 and on the bottom of elongate primary wedge 36, in conjunction with, lateral confinement of opposing walls 16, 18 of engagement member 12 with opposing sidewalls 30, 32 of die holder 26 provide for compensation device 10 to hold its position during the application of repeated vertical forces by the press brake. These opposing flat orientations of top surface 52 with ceiling 27 and bottom surface 46 with floor 19 with opposing walls 16, 18 and opposing sidewalls 30, 32 provides a confinement of wedges 36 and 38 which resists unwanted lateral movement between engagement member 12 and die holder 26 with application of vertical forces from the press brake, sometimes referred to as side thrusts.

In referring to the channels 20 and 34, we will look to FIGS. 3, 4, 6 and 7. As previously described channel 20 is defined in engagement member 12 with opposing walls 16, 18 and floor 19 that spans between opposing walls 16, 18. In this embodiment, with engagement member 12 secured to a bed of a brake press, floor 19 will be positioned in a generally horizontal position and opposing walls 16, 18 will be positioned to extend in a vertical direction. In referring to FIGS. 6 and 7, wall 18 extends to a higher elevation than wall 16. Elongated primary adjustment wedge 36 lies with its flat bottom 46 abutting floor 19 of engagement member 12 along the length of elongated primary adjustment wedge 36 which is coextensive in length in this embodiment with engagement member 12. As will be described in more detail below, in this embodiment, elongated wedge 36 is initially positioned in channel 20 to have its back wall 54, which extends generally vertical from its bottom 46, abut inner surface 56 of opposing wall 18 and have front wall 58 be positioned spaced apart from wall 16.

Opposing walls 30, 32 of die holder 26, are spaced apart to allow walls 30, 32 to move relative to opposing walls 16, 18 of engagement member 12, with die holder being moved in vertical directions with movement of elongated primary wedge 36 and/or secondary adjustment wedges 38, as will be discussed in more detail below. As can be seen in FIGS. 6 and 7, wall 32 is longer than wall 30 and corresponds to wall 18 of engagement member 12 which is longer than wall 16 of engagement member 12. With respect to wall 32, it has an inner surface 60 which extends generally vertical to where top portion 28 of die holder 26 extends a wall portion 62 which extends in a horizontal direction spaced apart over and generally parallel to top 64 of wall 18. Wall portion 62 extends in a horizontal direction, in this embodiment, and ends spaced apart from back wall 54 of elongated primary adjustment wedge 36 and then top portion 28 extends another wall portion 66 vertically also spaced apart from back wall 54 of elongated primary adjustment wedge 36. An angularly extending transition wall 68 extends toward an inner portion of compensation device 10 and meets vertical wall member 70 formed by top portion 28 wherein vertical wall member has a surface 72 that is generally in vertical alignment with inner surface 56 of wall member 18. Surface 72 extends vertically and meets ceiling 27 at right angle to ceiling 27. Ceiling 27, of die holder 26, extends horizontally to where it meets wall member 74 which has surface 76 which extends vertically downward. In this embodiment, surface 76 extends a length that is approximate to the length or thickness of front side 78 of wedge 38. Surface 76 extends to inclined wall member 80 formed by top portion 28. The angle of inclination of this wall member 80 is approximately parallel to that of the top 48 and bottom 50 surfaces of elongated primary adjustment wedge 36 and secondary adjustment wedges 38, respectively, and is approximately aligned with top 48 and bottom 50 surfaces. As inclined wall member 80 extends spaced apart over the top of wall 16 a horizontal surface 82 extends from inclined wall member 80. Horizontal surface 82 extends until it meets inner vertical surface 84 of wall 30 that extends parallel to outer surface of wall 16. In this embodiment, channel 34, in which secondary wedges 38 are located, is generally defined by top portion 28 with surface 72 of wall member 74, ceiling 27 and surface 76 of wall member 74, as seen in FIGS. 6 and 7.

Figure 9:
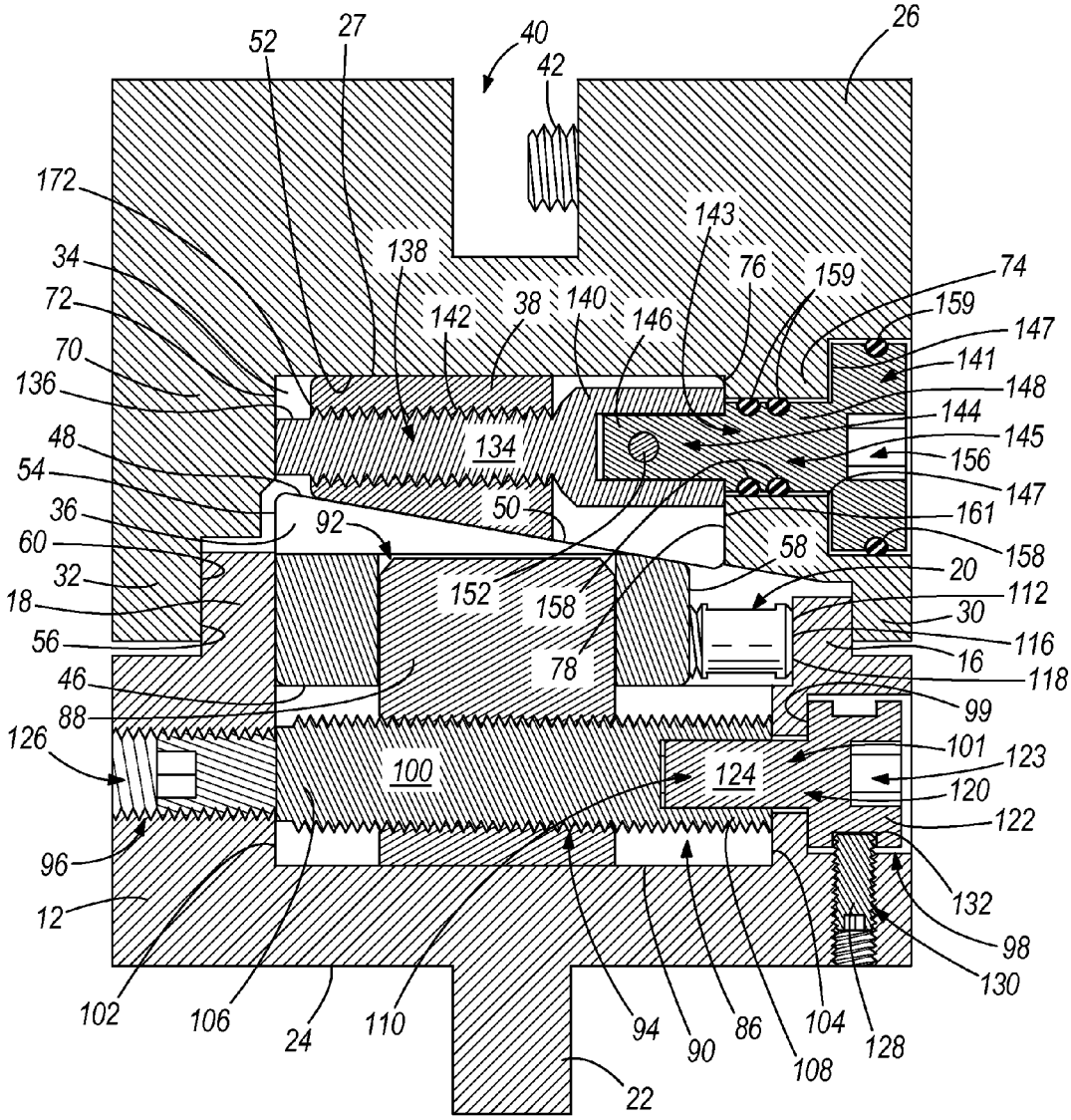
FIG. 9 is a cross section view of the assembled compensation device for a press brake die as seen along line 9-9 of FIG. 8.

Referring to FIGS. 3, 4, 6, 7 and 9 assembling compensation device will be addressed. This assembling is merely one embodiment of assembling and other embodiments will be apparent from this description. Engagement member 12 is positioned such that channel 20 is facing in an upward direction. In this embodiment, a recess 86 is defined in floor 19 in a central portion of engagement member 12, as seen in FIGS. 3 and 9. Recess 86 is sufficiently deep to receive force transmittal member 88. Force transmittal member 88, in this embodiment, takes on a generally cylindrical external shape. Force transmittal member 88 can be made into many different shapes. With member 88 standing on end as seen in FIG. 9, force transmittal member 88 projects from bottom 90 of recess 88 to an elevation above floor 19 such that that an upper portion of force transmittal member 88 will be received by opening 92, as seen in FIGS. 3 and 4, defined in a center portion of elongated primary adjustment wedge 36 while wedge 36 is lying on floor 19 of channel 20. In this embodiment, opening 92 is positioned generally in the center of the length elongated wedge member 36 and is dimensioned to allow an upper portion of force transmittal member 88 to snuggly slide into opening 92.

Force transmittal member 88 defines a threaded bore opening 94 that passes through member 88. This threaded opening 94 is positioned in the force transmittal member 88 such that with force transmittal member 88 resting on bottom 90, as seen in FIG. 9, threaded bore opening 94 is in alignment with two opposing bore openings 96, 98 defined in the back and front of engagement member 12 of compensation device10, as seen in FIGS. 4 and 9. Bore opening 96 is a threaded opening defined in engagement member 12 on its back side and opening 98 on the front side of engagement member 12 is an unthreaded bore. In this embodiment, bore opening 98 is a generally cylindrical shaped bore with a shoulder 99 defining an opening 101, as seen in FIG. 9.

An adjustment bolt assembly will be described herein which will be utilized to move force transmittal member 88 within recess 86 to turn deflect or move a central portion of elongated primary adjustment wedge 36 in a transverse direction relative to the elongated direction the compensation device 10 extends. Threaded bolt segment 100, as seen in FIGS. 4 and 9, has threads compatible to threads defined in threaded bore opening 94 within force transmittal member 88. Threaded bolt segment 100 is screwed into threaded bore opening 94 of force transmittal member 88. Threaded bolt segment 100 is sufficiently screwed into and through threaded opening 94 such that a portion of threaded bolt segment extends out of one side of force transmittal member 88, and another portion extends out of an opposing side of force transmittal member 88, as seen in FIG. 9. It should be noted that threaded bolt segment 100 has a length such that it extends and fits between and snuggly abuts opposing walls 102, 104 of recess 86, as seen in FIG. 9. This snug fit abutment between opposing walls 102, 104 prevents bolt segment 100, which is engaged to force transmittal member 88, from moving in a back to front and/or front to back direction a direction transverse to the length of engagement member 12 during operation of the press brake. This snug fit helps to maintain primary adjustment wedge 36 which is engaged to force transmittal member from undesirable movement and prevents undesirable changes to crowning of die holder 26 during operation and provides consistent results in forming the work piece. Force transmittal member 88 needs to be positioned in recess 86 for a top portion of member 88 to engage opening 92 of elongated wedge 36 when wedge 36 is positioned within channel 20. In properly positioning force transmittal member 88 in recess 86, threaded bolt segment 100 must also be properly aligned within recess 86. End 106 of threaded bolt segment 100 is positioned to abut wall 102 and cover threaded bore opening 96 and opposite end 108 which defines a bore opening 110, is positioned such that end 108 abuts wall 104 and bore opening 110 aligns with bore openings 98 and 10, as seen in FIGS. 3, 4 and 9. With properly positioned threaded bolt segment 100 and force transmittal member 88 within recess 86, elongated wedge 36 can be further assembled to be positioned within channel 20.

As can be seen in FIGS. 3, 4 and 9 threaded spacing members 112 are screwed into threaded bores 114 positioned at opposing end potions of elongated primary adjustment wedge 36, as seen in FIG. 3. These threaded bores 114 face the front side of compensation device 10 and extend into elongated primary adjustment wedge 36 in a direction transverse to the elongated direction of wedge 36. Threaded bores 114 are positioned one each at opposing end portions of elongated wedge 36. Threaded spacing members 112 are screwed into each of the two threaded bores 114 such that the distance from back wall 54 of primary adjustment wedge 36 to the furthest end 116 of threaded spacing members 112, as seen in FIGS. 3 and 9, will provide a snug fit between the inner surface 56 and 118 of opposing walls 18 and 16, respectively, with elongated wedge 36 placed into channel 20. Thus, with threaded spacing members 112 secured into bores 114 with the distance between back wall 54 of wedge 36 and furthest end 116 of threaded spacing member 112 closely matching the distance between inner surfaces 56 and 118 of opposing walls 18 and 16, back wall 54 and furthest end 116 can be slid along inner surfaces 56 and 118 thereby securing back wall 54 of wedge 36 to abut against inner surface 56 of wall 18 and furthest end 116 of threaded spacing member 112 abuts inner surface 118 of wall 16. With this arrangement, back wall 54 of primary adjustment wedge 36 is positioned to abut inner surface 56 along the length of back wall 54. However, back wall 54 is held tightly against surface 56 of wall 18 proximate to the spacing members 112 on opposing end portions of wedge 36, in contrast to the span of back wall member 54 positioned between the spacing members 112 which is not held as tightly as you move further away from spacing members 112 along primary adjustment wedge 36.

Thus, with bolt segment 100 properly engaged with force transmittal member 88, with both bolt segment 100 and member 88 properly aligned and positioned within recess 86 and with spacing members 112 engaged with primary adjustment wedge 36, wedge 36 can be placed on floor 19 of channel 20 segment with back wall 54 abutting inner surface 56 of wall 18 and top portion of member 88 can be engaged with opening 92 of wedge 36. At this juncture, adjustable bolt assembly utilizing threaded bolt segment 100 can be assembled. Bolt head segment 120, as seen in FIGS. 3, 4 and 9, provides a head 122 wherein head 122 defines an engagement bore opening 123 typically shaped in this embodiment to receive a tool to assist in turning head 122, such tool may include a hex key or Allen wrench, screw driver or the like. On an opposing side of head 122 is extension 124, having in this embodiment, a square cross section sized and dimensioned to be snugly and slidably compatibly received by bore opening 110 defined by threaded bolt segment 100 which also has for this embodiment a square cross section. It is contemplated that the engagement structure between bolt segment 100 and bolt head segment 120 could be reversed in that bolt segment 100 could provide an extension that could be received by a bore defined by bolt head segment 120. Other compatible cross section shapes of bore opening 110 and extension 124 are contemplated. With bore opening 110 having a cross section that is sized and shaped to compatibly receive a similarly sized and shaped extension 124, the turning of head 122 will in turn, turn threaded segment 100. With threaded bolt segment 100 abutting opposing surfaces 102 and 104 of recess 86, threads of threaded bolt segment 100 which are engaged with threads of threaded bore opening 94 of force transmittal member 88, turning of head 122 will cause force transmittal member 88 to move in a transverse direction relative to the length of the elongated primary adjustment wedge 36. In this arrangement, the threads of threaded bolt segment 100 and threaded bore opening 94 are oriented such that turning head segment 120 in a clockwise direction will cause force transmittal member 88 to move toward wall 104 of recess 86 thereby pulling the center portion of primary adjustment wedge 36 toward wall 16 while end portions of wedge 36 resist movement of back wall 54 away from inner surface 56 of wall 18 thereby arching primary adjustment wedge 36 along floor 19 of channel 20. This arching of primary wedge 36 will in turn impart a crowning configuration to die holder 26 and likewise impart a crown configuration in die secured to die holder 26.

With head bolt head segment 120 engaged to threaded bolt segment 100 and a central portion of primary adjustment wedge 36 is positioned in a desired displaced position, a set screw 126 can be screwed into threaded bore opening 96 to which bolt segment 100 is aligned. Set screw 126 can be tightened with any accommodating tool such as a screw driver or hex key or Allen wrench or the like, based on the head configuration of set screw 126. With set screw tightened into threaded opening 96 and abutting threaded bolt segment 100, this arrangement will help prevent unwanted turning of threaded bolt segment 100 during operation of the press brake. In addition, another set screw 128, as seen in FIGS. 3, 4 and 9, can be used to secure wedge 36 in its desired position with the insertion of other set screw 128 into threaded bore 130, as seen in FIG. 9, and tightened by any conventional tool such as a screw driver or alan wrench or the like depending on the head configuration of other set screw 128. With set screw 128 screwed into bore 130 far enough so that set screw 128 is tightened against bottom of channel 132, defined in head segment 120, this will configuration will also resist unwanted turning of threaded bolt segment 100 during operation of the press brake. Unwanted turning of bolt segment 100 during operation of the press brake will prevent unwanted movement of force transmittal member 88 and thereby prevent unwanted movement of primary adjustment wedge 36. Inconsistent forming results will be experienced should wedge 36 be permitted to move during the press brake operation since die holder 26 will change positions upon movement of wedge 36. Movement of die holder 26 will result in reconfiguration of the die it holds resulting in inconsistent results in forming work pieces.

With elongated primary adjustment wedge 36 positioned within channel 20, with end portions of wedge 36 restricted from movement by spacer members 112 and the central portion of wedge 36 engaged with force transmittal member 88, secondary adjustment wedges 38 can be assembled and placed in channel 34 of die holder 26. As can be appreciated, there is no particular order for assembling wedge members 36 into channel 20 and assembling secondary wedge members 38 into die holder 26.

For ease in assembling die holder 26, die holder 26 can be turned such that channel 34 faces upwardly. An internal bolt segment 134, as seen in FIGS. 3, 4 and 9, can now each be engaged with each secondary adjustment wedge segment 38. Internal bolt segment 134 has a non-threaded end portion 136 on one end, a threaded portion 138 positioned between non-threaded end portion 136 and an internal head portion 140, which is positioned on an opposing end. The length of internal bolt segment 134, as seen in FIG. 9, closely matches the width dimension between opposing surfaces 72 and 76 of vertical wall members 70 and 74 respectively, of die holder 26. A snug fit is made with internal bolt segment 134 positioned to span between and abut opposing walls 70, 74 having surfaces 72 and 76. This snug fit abutment between opposing walls 70, 74 having surfaces 72 and 74 prevents bolt segment 134, which is engaged to each secondary adjustment wedge 38, from moving in a back to front and/or front to back direction being a direction transverse to the length of engagement member 12 during operation of the press brake. This snug fit helps to maintain each secondary adjustment wedge 38 from undesirable movement and prevents undesirable changes to crowning of die holder 26 during operation. This arrangement provides consistent results in forming the work piece. Each secondary adjustment wedge 38 has a threaded bore 142 positioned within a notch 170 formed on the front side of secondary adjustment wedge 38. Threaded bore 142 extends through wedge 38 in a direction transverse to the length of each of secondary adjustment wedge 38. Internal bolt segment 134 is screwed into each respective threaded bore 142 until the head portion 140, being of a greater dimension than threaded portion 138 abuts the base of notch 170 of wedge 38. With internal bolt segment 134 inserted through threaded bore opening 142 with non-threaded extending out of the back end 172 of secondary adjustment wedge 38, wedge 38 can be inserted into channel 34 of die holder 26 and positioned such that non-threaded portion 136 which extends out of back side 172 of secondary adjustment wedge 38 abuts surface 72 and internal head portion 140 abuts opposing surface 76, as seen in FIG. 9.

In referring to FIG. 9, internal head portion 140 defines a bore opening 144. With wedge 38 placed in channel 34, top surface 52 abuts ceiling 27, non-threaded portion 136 abuts wall surface 72 and internal head 140 abuts opposing wall surface 76. Additionally, bore opening 144 defined by internal bolt segment 134 aligns with bore opening 145 defined in die holder 26 as seen in FIGS. 3, 4 and 9. Bore opening 145 is configured, as seen in FIG. 9, to have a generally cylindrical outer bore 141 which aligns with a smaller cylindrically shaped inner bore 143 wherein a shoulder 147 is provided at the base of inner bore 143.

With each of the wedge members 38 and bolt segment member 134 properly positioned within channel 34 of die holder 26, bolt head segment 148 can be secured to bolt segment member 134. Extension 146 extends from bolt head segment 148 and has a cross section shape and size to be compatibly received by bore opening 144 having a similar cross section shape and size. Extension 146 can be passed through bore opening 145 and inserted into bore opening 144 of internal head portion 140. The compatible cross section shapes of extension 146 and bore opening 144 will permit bolt segment 134 to turn with the turning of bolt head segment 148. In this embodiment, the cross section of bore opening 144 is square and the cross section of extension 146 is square. It is contemplated that the engagement structure between bolt segment 134 and bolt head segment 148 could be reversed in that bolt segment 134 could provide an extension that could be received by a bore defined by bolt head segment 148.

With wedge segments 38 each placed in channel 34 and extensions 146 inserted into bore openings 144, extension 146 can be secured to internal bolt head 140 so as to prevent unwanted removal of extension 146 from bore opening 144. A threaded bore opening 150 defined in internal head portion 140 is accessible to the operator, as seen in FIG. 4. Extension 146 defines a bore opening 152, as seen in FIG. 9. Bolt head segment 148 is inserted into opening 145 thereby causing extension 146 to insert into bore opening 144 such that opening 152 and 150 align with one another. Set screw 154 is screwed into opening 150 and enters opening 152 of extension 146 and is tightened. This arrangement secures the engagement of internal bolt segment 134 to bolt head segment 148. With set screw 154 secured, wedge segments 38 retain position within channel 34 of die retainer 26 for assembly of die holder 26 to engagement member 12.

Bolt head segment 148 defines a bore opening 156. Opening 156 is configured to permit ease in turning bolt head segment 148 with a screw driver or alan wrench or other tool for assisting the turning of bolt head segment 148. Channels 158 are defined circumferentially about bolt head segment 148, as seen in FIG. 9. In this embodiment, three channels are positioned around the circumference of bolt head segment 148. Within each of these channels 158 is positioned an o-ring 159, as can be seen in FIGS. 4 and 9. With bolt head segment 148 positioned in bore opening 145 of die holder 26, o-rings 159 are compressed and a friction force is created between bolt head segment 148 and a surface of opening 145. This frictional engagement inhibits undesirable turning of bolt head segment 148 during the operation of the press brake and bolt head segment 148 as well as bolt segment 134 maintains a desired position and thereby maintains the desired position of secondary adjustment wedges 38 once those positions are set, which will be described below in more detail. In this embodiment, each secondary wedge 38 is positioned in channel 34 such that top surface 52 abuts ceiling 27 of die holder 26 and front face 78 of wedge 38. as seen in FIGS. 6, 7 and 9, abuts surface 76 of wall 74 of die holder 26.

With each wedge segment 38 positioned end to end within channel 34 and secured within channel 34, with bolt segment 134 and bolt head segment 148, of die holder 26 and elongated primary adjustment wedge 36 is assembled within channel 20, die holder 26 can be turned over and lowered over engagement member 12, such that opposing walls 30, 32 of die holder 16 are positioned outside of opposing walls 16, 18 of engagement member 12, until inclined surfaces 48 and 50 of wedges 38 and 36, respectively, rest upon each other. With die holder 26 in position over engagement member 12, these two items are now ready to be secured together.

Figure 5:
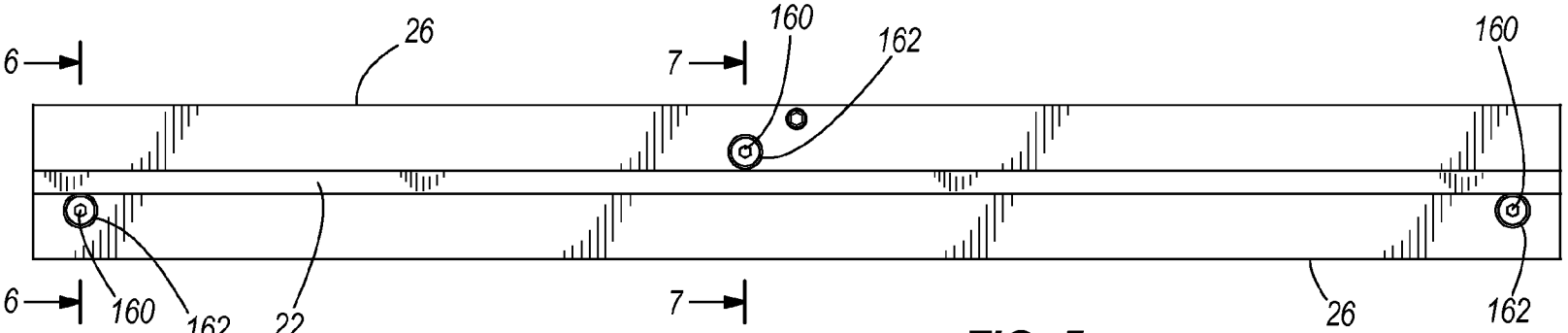
FIG. 5 is a bottom plan view of the exemplary embodiment of the assembled compensation device for a press brake die shown in FIG. 1.
Figure 8:
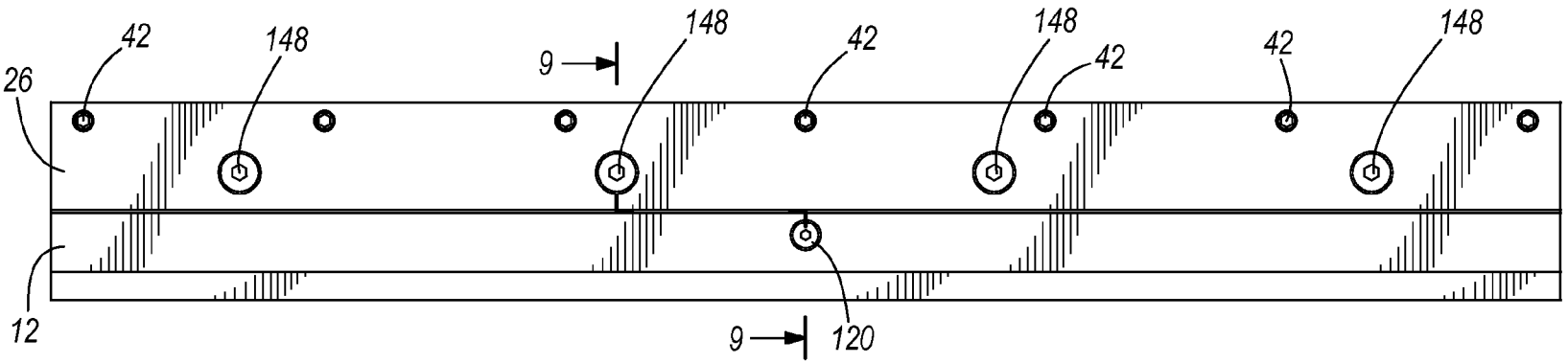
FIG. 8 is a front plan view of the exemplary embodiment of the assembled compensation device for a press brake die shown in FIG. 1.

In this embodiment, three bolts 160 are employed to secure die holder 26 and 3 engagement member 12 together. Bore openings 162 are positioned at each end of engagement member 12, as seen in FIG. 5. These two opposing end openings 162 are positioned closer to the back side of compensation device 10 and a central opening 162 is positioned closer the front side of compensation device 10.

In referring to FIGS. 3-7, of one of the three bolts 160 and how it is used to secure die holder 26 to engagement member 12 will be described and such description will apply to the other two bolts 160 that assist in securing die holder 26 and engagement member 12 together. In referring to FIG. 6, this depicts securing of die holder 26 to engagement member 12 at one end of compensation device 10, as seen in FIG. 5. Bore opening 162 is defined and extends vertically through engagement member 12. Opening 162 narrows at shoulder 164 defined by engagement member 12, A threaded bore opening 166 is defined in die holder 26 and is aligned with bore opening 162. Bolt 160 carrying spring washer 168 wherein washer 168 is positioned onto bolt 160 and will ultimately be positioned between head 180 of bolt 160 and shoulder 164. Spring washer 168 because it is constructed of a urethane material or the like, spring washer 168 can be compressed. Bolt 160 is inserted into and through bore opening 162 extends by elongated wedge 36 and wedge segment 38 by way of notches 182 and 184 defined in elongated primary adjustment wedge 36 and secondary adjustment wedge segment 38, respectively, as shown in FIGS. 3 and 4. End portion of bolt 160 defines threads 186. Threads 186 are configured to compatibly engage threaded bore opening 166. Head 180 defines an opening 188 which is configured to receive a tool to assist in turning bolt 160 such as a screw driver or hex key or Allen wrench or the like. As bolt 160 is turned and penetrates threaded bore opening 166, head 180 pushes against washer 168. With bolt 160 threadingly engaged into threaded opening 166 die holder 26 and engagement member 12 are assembled. With bolt 160 tightened against washer 168 and washer 168 such arrangement still permits die holder 26 to move upwardly relative to engagement member 12 by way of use of primary adjustment wedge 36 and/or secondary adjustment 38 as will be described below. With die holder 26 moving upwardly relative to engagement member 12, washer 168 will correspondingly compress, accommodating such movement. This arrangement is similarly replicated for securing the central portion and opposing end portion of compensation device 10.

With compensation device 10 now assembled, it is ready to be used. Engagement member 12 can be secured to the bed of a press brake and a die can be secured to die holder 26. The following description of utilizing the compensation device 10 is exemplary and is portrayed in FIGS. 9-11.

Figure 10:
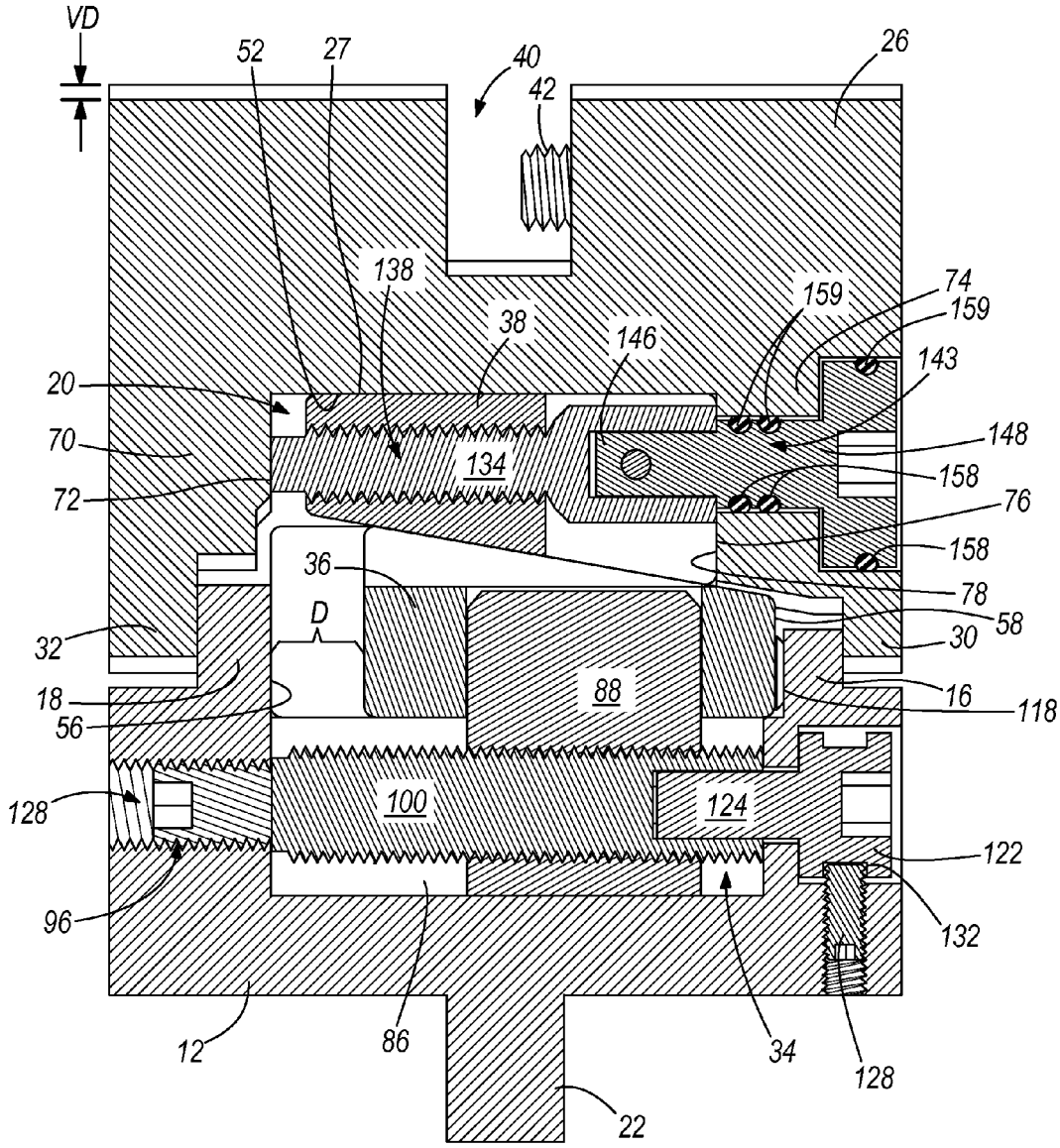
FIG. 10 is a cross section view of the assembled compensation device for a press brake die as seen along line 9-9 of FIG. 8 wherein a central portion of a lower elongated primary adjustment wedge has been moved thereby raising the die holder of the compensation device and thereby imparting a crown configuration in the die holder.

In referring to FIG. 9, elongated primary adjustment wedge 36 is positioned on floor 19 of channel 20 of engagement member 12. Back wall 54 of elongated primary wedge 36 abuts surface inner surface 56 or wall 18. Opposing end portions of elongated wedge 36 has back wall 54 secured in the abutting position with threaded spacing members 112, as shown in FIGS. 3, 4 and 9. At this point, the operator engages a screw driver, alan wrench or other suitable tool that will engage opening 123 of head 122 of bolt head segment 120 and will turn head 122. In this embodiment, turning head 122 clockwise with the threads of threaded bolt section 100 and threads of threaded bore opening 94, defined in force transmittal device 88, compatibly sized and appropriately oriented and with end 106 and opposing end 108 of threaded bolt section 100 abutting opposing walls 102 and 104 in recess 86, force transmittal member 88 will be moved toward the front of compensation device 10 or toward wall 104 of recess 86. This movement of the force transmittal member 88 moves the central portion of elongate primary adjustment wedge 36 toward the front of compensation device 10 toward wall 16 while opposing end portions of elongate primary adjustment member 36 are held in abutting position against inner surface 56 of wall 18. This deflection of the central portion of primary wedge 36 begins to move elongate primary wedge 36 into taking on an arch shape along floor 19 of channel 20 of engagement member 12. In taking this arch configuration the inclined top surface 48 of wedge 36 slides along inclined bottom surfaces 50 of secondary adjustment wedges 38 causing elongated wedge to push upwardly on secondary adjustment wedges 38 resulting in die holder 26 moving upward in a vertical direction VD, as can be seen in FIG. 10. The movement of the central portion of elongated primary wedge 36 toward wall 16 causes a crowning configuration to be imparted to die holder 26 and to the die. The operator will determine the amount of crowning needed to provide compensation to the press brake operation and will position force transmittal member accordingly. With appropriate crowning imparted to die holder 26, the operator will no longer move force transmittal member 88 and will lock in that position by securing both set screws 126 and 128 as previously described.

In referring to FIG. 10, the operator has moved a central portion of elongated wedge 36 such that front surface 58 of elongated wedge 36 nearly contacts inner surface 118 of wall 16. It can be seen, that central portion of elongated wedge member 36 has been deflected a distance D from inner surface 56 of wall 18, while back wall 54 at opposing end portions of elongated wedge member 36 still abuts inner surface inner surface 56 of wall 18 with spacer members 112 employed. With this orientation of elongated wedge member 36, a maximum crowning configuration along the length of die holder 26 is imparted to die holder 26. With the desired configuration obtained by the operator, as mentioned above, can tighten set screw 128 to abut against bottom of circumferentially positioned channel 132 defined in head 122 of bolt head segment 120. Set screw 128 will now resist head 122 from undesired turning with the press brake in operation which would cause undesired alteration of the crowning configuration during operation. Similarly, the operator can tighten set screw 128 to abut bolt segment 100 and lock bolt segment 100 from turning and undesirably moving force transmittal member 88 curing operation of the press brake.

Figure 11:
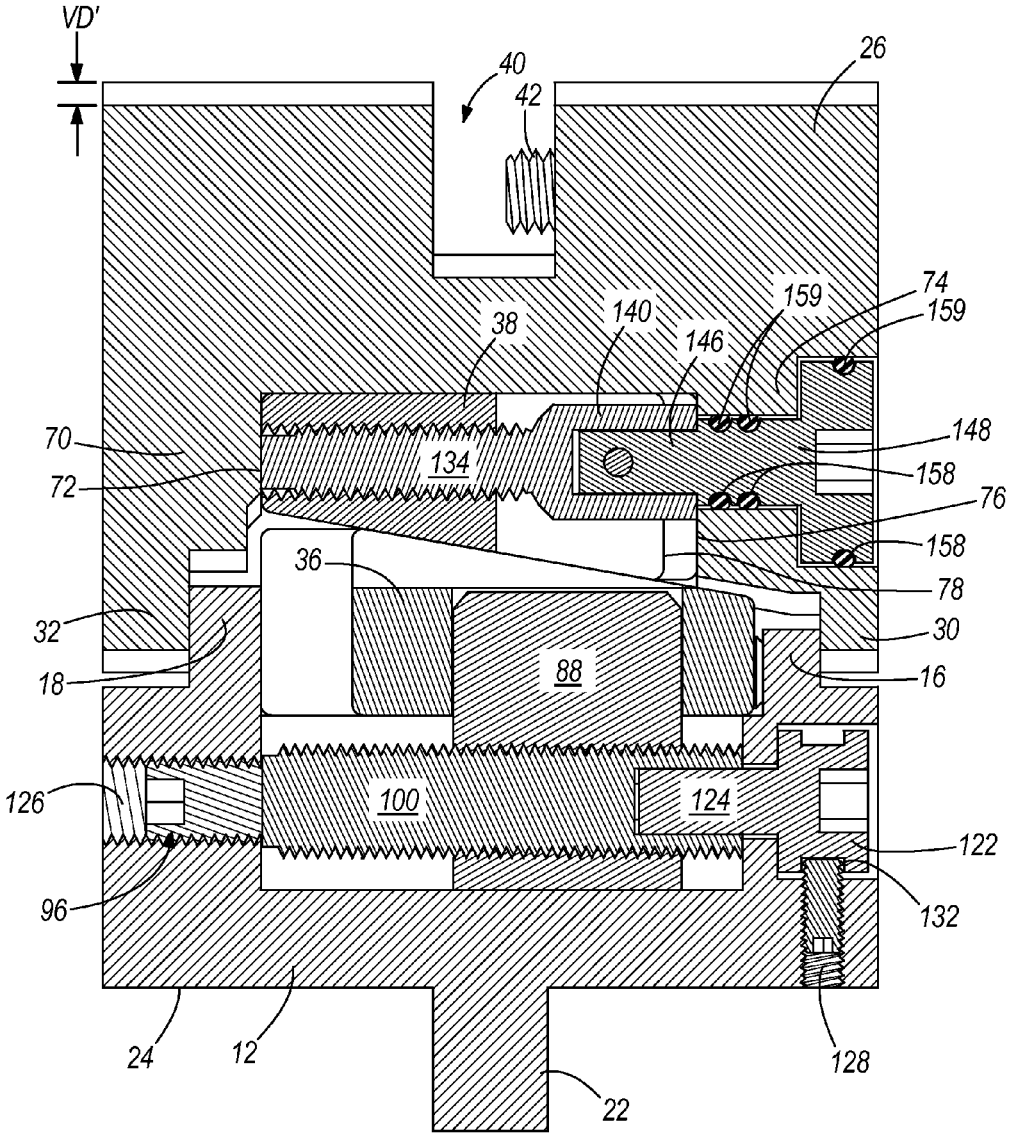
FIG. 11 is a cross section view of the assembled compensation device for a press brake die as seen along line 9-9 of FIG. 8 wherein the central portion of the lower elongated primary adjustment wedge is shown in its displaced position as shown in FIG. 10 and an upper secondary adjustment wedge has now been moved thereby changing (in this instance increasing) the elevation of the die holder of the compensation device from its elevation shown in FIG. 10.

In referring to FIG. 11, the operator after having run the press brake has noted undesirable results in the work piece such as localized unwanted flattening of the work piece as well as other unwanted results which occur in forming elongated work pieces. The original setting of the crowning of the die holder 26 did not provide acceptable compensation and therefore uniformity in configuration of the work piece. In some instances, the need for adjustment to compensation may be in a single location along the work piece and in other instances it may be in multiple locations. Secondary adjustment wedges 38 can now be used to address this issue. Multiple secondary wedges 38 are positioned end to end along the length of elongated primary adjustment wedge 36 and die holder 26 in this embodiment thereby providing adjustability of the die holder 26 along the length of die holder 26. Thus, once the operator has made a run on the press brake and observed the resulting work piece, he can now determine where in the length of the compensation device 10 adjustments need to be made to provide the desired uniformity in the work piece.

In the example shown in FIG. 11, the operator has determined he must make a localized fine tuning adjustment to the elevation of die holder 26. A particular secondary adjustment wedge member 38 which corresponds to the position(s) on the work piece that needs adjustment is selected. In this example, the selected secondary adjustment wedge 38 was originally positioned wherein its front side 78 is positioned abutting surface 76 of wall 74, as seen in FIG. 10. The operator has determined that additional localized elevation must be imparted to die holder 26. Operator turns bolt head segment 148 clockwise and with the appropriate orientation of threads positioned on bolt segment 134 and defined in threaded bore 142 of wedge 38, adjustment wedge 38 moves toward surface 72 of wall 70. In this example, in FIG. 11, back wall 172 of secondary adjustment wedge 38 has now been positioned against surface 72. This movement of at least one secondary adjustment wedge 38 has caused an additional localized vertical displacement of die holder 26 in the locale of wedge 38 as seen as VD'. Again, any number of secondary adjustment wedges 38 may be moved as needed to alter the crowning configuration imparted to die holder 26 by elongated primary wedge member 36. These adjustments to secondary wedges 38 along the length of compensation device 10 provide easy fine tuning of forming performance of the work piece along the length of the work piece.

With this assembly, localized elevations of die holder 26 can be easily raised and lowered. The operator simply needs to adjust the position of adjustment wedge 38 along a path that is transverse to the length of compensation device 10. Operator simply turns bolt head segment 148 clockwise or counter clockwise and secondary adjustment wedge 38 will slide relative to wedge 36 along parallel inclined surfaces 48 and 50 toward the back and front of compensation device 10, respectively. Movement of wedge 38 toward wall surface 72 will increase the localized elevation of die holder 26 and movement of wedge 38 toward wall surface 76 will reduce the localized elevation of die holder 26. Thus, easy fine tuning of die holder 26 of compensation device 10 can be accomplished by the operator by fine tuning the position of selected secondary adjustment wedge members 38, resulting in the successful and efficient operation of a press brake.

The foregoing description is has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

The invention claimed is:

1. An adjustment compensator device for a press brake die comprising:

an elongate engagement member;

an elongate die holder;

an elongate primary adjustment wedge positioned between and extending along at least a portion of the elongate engagement member and the elongated die holder, and at least a portion of primary adjustment wedge is adjustable in a direction transverse to an elongate length of the engagement member; and at least two elongate secondary adjustment wedges wherein a length of each of the secondary adjustment wedges is less than a length of the primary adjustment wedge, wherein the elongate secondary adjustment wedges are positioned end to end in a direction along a length of the die holder and positioned between the engagement member and the die holder, and are each adjustable in a direction transverse to the elongate length of the engagement member.

2. The adjustment compensator device of claim 1 wherein the primary adjustment wedge defines a flat bottom surface and an inclined top surface.

3. The adjustment compensator device of claim 2 wherein the engagement member defines a channel with a flat bottom wherein the flat bottom of the primary adjustment wedge is positioned to rest on the flat bottom of the channel.

4. The adjustment compensator device of claim 3 wherein the width dimension, in a direction transverse to a length of engagement member, of the primary adjustment wedge is less than the width dimension, in the direction transverse to the length of the engagement member, of the channel.

5. The adjustment compensator device of claim 2 wherein the at least two secondary adjustment wedges each define an inclined bottom surface being parallel to the inclined top surface defined by the primary adjustment wedge, wherein the bottom surface of the secondary adjustment wedge rests on the top surface of the primary adjustment wedge.

6. The adjustment compensator device of claim 1 wherein the at least two secondary adjustment wedges define flat top surfaces wherein the flat top surfaces of the secondary adjustment wedges are positioned to abut a flat ceiling defined by the die holder.

7. The adjustment compensator device of claim 1 wherein the die holder defines another channel wherein a width dimension of the channel, in a direction transverse to the elongate length of the die holder, is greater than the width dimension, in a direction transverse to the elongate length of the die holder, of the at least two secondary adjustment wedges.

8. The adjustment compensator device of claim 1 wherein the at least two secondary adjustment wedges are independently movable relative to the die holder.

9. The adjustment compensator device of claim 1 wherein the elongate primary adjustment wedge comprises opposing end portions along a length of the wedge wherein the opposing end portions of the wedge are secured to the elongate engagement member and resists movement of the end portions of the wedge in a direction transverse to the length of the engagement member.

10. The adjustment compensator device of claim 9 includes a force transmittal member engaged to a central portion of the primary adjustment wedge for imparting a force to the primary adjustment wedge to a central portion of the primary adjustment wedge.

11. An adjustment compensator device for a press brake die comprising:

a bolt segment having a length and defining threads along at least a portion of the length, wherein the length of the bolt segment substantially matches a distance between two opposing walls positioned within one of a die holder and an engagement member such that opposing ends of the bolt segment abut the two opposing walls; and a bolt head segment adapted to couple with the bolt segment, wherein one of the bolt segment and the bolt head segment define a bore opening and the other of bolt segment and bolt head segment includes an extension such that the extension is accessible through another bore opening defined in one of the die holder and engagement member and is receivable within the bore opening defined in the one of the bolt segment and the bolt head segment.

12. The adjustment compensator device of claim 11 threads extend substantially the length of the bolt segment.

13. The adjustment compensator device of claim 11 wherein a cross section of the bore opening defines a square.

14. The adjustment compensator device of claim 11 wherein a cross section of the extension defines a square.

15. The adjustment compensator device of claim 11 wherein the bolt head segment defines a channel positioned about a circumference of the bolt head segment.

16. The adjustment compensator device of claim 15 further including a set screw associated with one of the die holder and engagement member and dimensioned to engage the channel of the bolt head segment and abut a bottom of the channel.

17. The adjustment compensator device of claim 11 further including another set screw associated with one of the die holder and engagement member and dimensioned to engage an opposing end of the bolt segment.

18. The adjustment compensator device of claim 11 wherein the bolt segment further includes an internal head portion defining the bore opening positioned at one end of the bolt segment around the bore opening wherein the internal head defines a threaded opening which communicates with the bore opening an extends in a direction transverse to the bore opening.

19. The adjustment compensator device of claim 18 wherein the extension defines an opening such that the threaded opening of the internal head aligns with the opening defined by the extension with the extension engaged within the bolt segment.

20. The adjustment compensator device of claim 19 wherein a set screw is engaged with the threaded opening of the internal head portion and engaged with the opening defined in the extension.

21. The adjustment compensator device of claim 11 wherein the bolt head segment defines at least one channel positioned circumferentially about the bolt head segment.

22. The adjustment compensator device of claim 21 wherein an o-ring is positioned within the at least one channel.

23. A method for assembling an adjustable compensator device for a press brake, comprising the steps of:

engaging a bolt segment which defines threads along at least a portion of a length thereof with a threaded bore defined in a force transmittal member;

positioning a portion of the bolt segment to extend outwardly from one side of the force transmittal member and positioning another portion of the bolt segment to extend outwardly from an opposing side of the force transmittal member; and placing the bolt segment and force transmittal member between two opposing walls within an engagement member such that opposing ends of the bolt segment abut the two opposing walls.

24. The method of assembling a compensator device of claim 23 includes providing an elongate primary adjustment wedge defining an opening in a central portion of the wedge engaging a top portion of the force transmittal member into the opening.

25. The method of assembling a compensator device of claim 24 includes securing opposing end portions of the elongate primary adjustment wedge to the engagement member.

26. The method of assembling a compensator device of claim 23 includes coupling a bolt head segment to the bolt segment.

27. The method of assembling a compensator device of claim 26 includes turning the bolt segment.

28. The method of assembling a compensator device of claim 27 includes screwing a set screw wherein the set screw defines threads into a threaded bore defined in the engagement member to abut the bolt segment.

29. The method of assembling a compensator device of claim 27 includes screwing another set screw which defines threads into another threaded bore defined in the engagement member for abutting the bolt head.

30. A method for assembling an adjustable compensator device for a press brake, comprising the steps of:

engaging a bolt segment which defines threads along at least a portion of a length thereof with a threaded bore defined in an adjustment wedge;

positioning a portion of the bolt segment to extend outwardly from one side of the adjustment wedge and positioning another portion of the bolt segment to extend outwardly from an opposing side of the adjustment wedge; and placing the bolt segment and the adjustment wedge between two opposing walls within a die holder such that opposing ends of the bolt segment abut the two opposing walls.

31. The method of assembling a compensator device of claim 30 includes coupling a bolt head segment to the bolt segment wherein the bolt head carries at least one o-ring about a circumferential portion of the bolt head segment.

32. The method of assembling a compensator device of claim 31 includes securing the bolt head segment to the bolt segment with a set screw engaging both the bolt head segment and the bolt segment.

33. The method of assembling a compensator device of claim 32 including turning the bolt head segment.

34. An adjustment compensator device for a press brake die comprising:

a bolt segment having a length and defining threads along at least a portion of the length, wherein the length of the bolt segment substantially matches a distance between two opposing walls positioned within one of a die holder and an engagement member such that opposing ends of the bolt segment abut the two opposing walls; and a bolt head segment adapted to couple with the bolt segment, wherein the bolt head segment defines at least one channel positioned circumferentially about the bolt head segment and wherein an o-ring is positioned within the at least one channel.

35. The adjustment compensator device of claim 34 wherein the bolt segment and the bolt head segment are secured to one another with a set screw which engages the bolt head segment through a threaded bore defined in the bolt head segment and engages the bolt segment with abutting the bolt segment within an opening defined in the bolt segment.

36. The adjustment compensator device of claim 34 includes three spaced apart channels and three o-rings wherein one o-ring is positioned within each channel.

* * * * *